US005924224A

United States Patent [19]

Demuth et al.

[11] Patent Number: 5,924,224

[45] Date of Patent: Jul. 20, 1999

[54] STEAM IRON WITH ANTI-DRIP DEVICE

[75] Inventors: Ulrich Demuth, Erbach; Peter Lameli, Lampertheim, both of Germany

[73] Assignee: Rowenta-Werke GmbH, Offenbach am Main, Germany

[21] Appl. No.: 09/041,711

[22] Filed: Mar. 13, 1998

[30] Foreign Application Priority Data

Mar. 20, 1997 [DE] Germany ..... 297 05 092 U

[51] Int. Cl.[6] ..... D06F 75/18

[52] U.S. Cl. ..... 38/77.8

[58] Field of Search ..... 38/77.3, 77.8, 38/77.5, 77.82, 77.83; 277/15, 26; 251/12, 176

[56] References Cited

U.S. PATENT DOCUMENTS 4,656,763 4/1987 Kawasaki et al. ..... 38/77.8

FOREIGN PATENT DOCUMENTS 44 10 408 9/1995 Germany .
80300 5/1984 Japan ..... 38/77.8
246800 12/1985 Japan ..... 38/77.8
1113098 5/1989 Japan ..... 38/77.8
2141497 7/1990 Japan ..... 38/77.3

*Primary Examiner*—Ismael Izaguirre
*Attorney, Agent, or Firm*—Cohen, Pontani, Lieberman & Pavane

[57] ABSTRACT

A steam iron having a water tank, a sole-plate that defines a steam chamber, a drip valve that connects the water tank to the steam chamber, and an anti-drip device includes a water supply channel between the water tank and the drip valve, a valve tappet with a sealing cone, and a return spring. The anti-drip device is a one-piece molded part of elastic material formed as an elongated seal.

3 Claims, 2 Drawing Sheets

STEAM IRON WITH ANTI-DRIP DEVICE

BACKGROUND OF THE INVENTION

1. Field of the Invention

The present invention relates to a steam iron.

2. Discussion of the Prior Art

In conventional steam irons, the flow of water from the water tank into the heated steam chamber during steam ironing is regulated via a drip valve. In the steam chamber, the supplied water is evaporated depending on the sole-plate temperature, whereby the desired temperature is preselected depending on the fabric to be ironed. These known steam irons have the disadvantage that at low sole-plate temperatures, more water flows into the steam chamber than can be evaporated therein, so that non-evaporated water emerges through the steam holes in the sole-plate and leaves undesired water spots on the material being ironed.

To avoid this disadvantage, it is known to regulate the flow of water from the water tank into the steam chamber depending on the sole-plate temperature. For example, a steam iron is known from German reference DE-OS 44 10 408, in which a bimetal controller effectively connected to the sole-plate acts directly on the drip valve. Furthermore, an anti-drip device is known that is arranged in the supply channel between the water tank and the drip valve. The drawback of this device is that it comprises many individual components and entails multiple additional ultrasonic welding steps and considerable assembly expense.

SUMMARY OF THE INVENTION

The object of the present invention is, starting from the generic prior art, to provide an anti-drip device that is economical as well as extremely easy to assemble.

Pursuant to this object, and others which will become apparent hereafter, one aspect of the present invention resides in a steam iron having an anti-drip device that is an elongated elastic seal with an integrated sealing element and return spring and is embodied as a one-piece molded part. The anti-drip device is effectively connected to a bimetal spring heated by the sole-plate, so that the flow of water from the water tank to the drip valve is regulated via the sealing element and the return spring in dependence on the sole-plate temperature. The sealing element has a sealing cone, and its free end extends through the inflow opening into the water tank, so that an additional guide for the sealing element can be dispensed with. Because the anti-drip device is made of an elastic material, no additional seal in the region of the tank bottom is necessary. The seal also serves as a seal between the drip valve and the tank bottom, and advantageously forms the water supply channel between the water tank and the drip valve. Advantageously, the anti-drip device is a silicone molded part, so that each time the iron is lifted, any encrusted lime will flake off from the sealing cone due to the rocking motion, and thus no lime build-up will occur in the area of the inflow opening.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
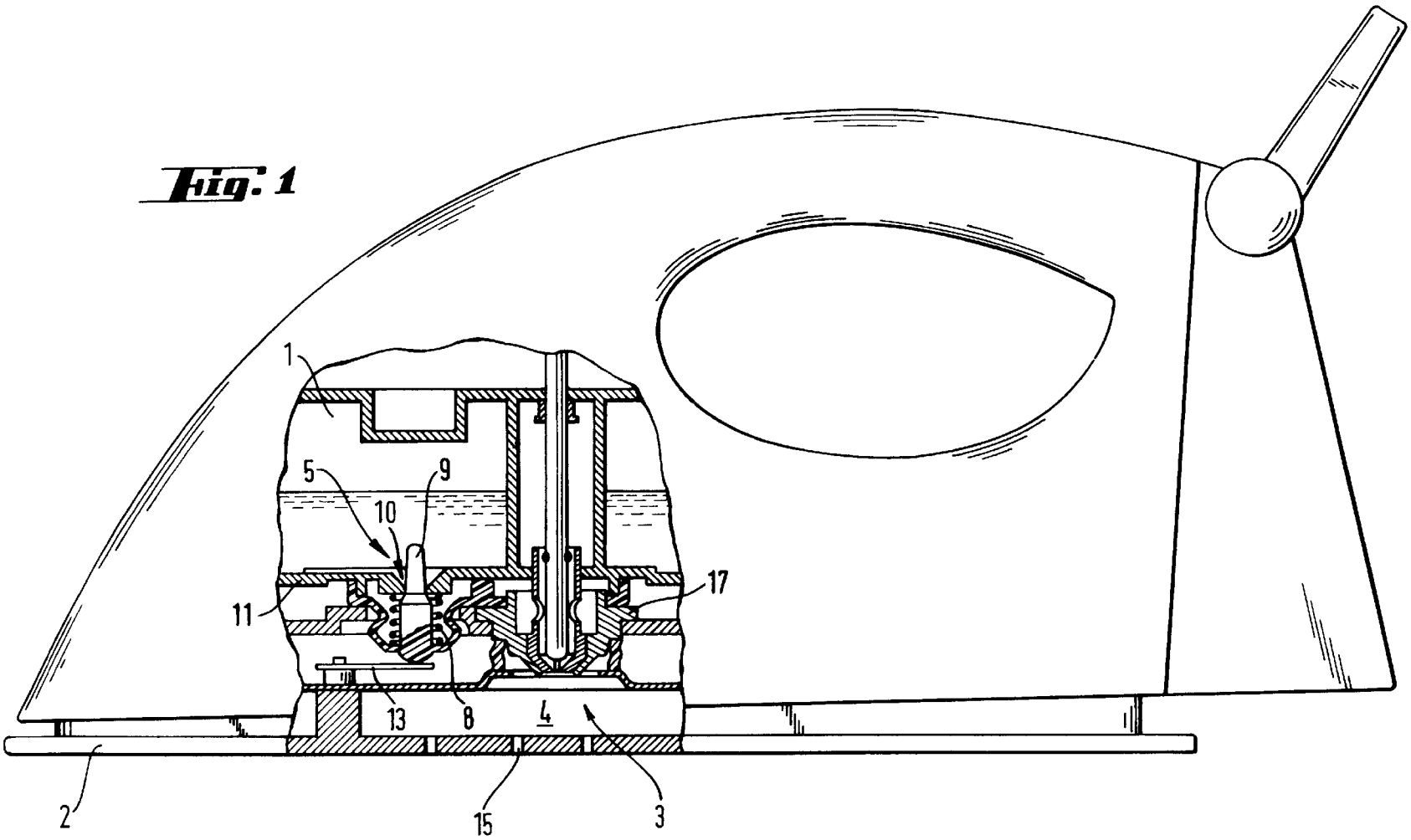
FIG. 1 shows an electric steam iron with the anti-drip device according to the invention.

FIG. 1 shows a steam iron with a water tank 1, a sole-plate 2 and a known drip valve 3. In the sole-plate 2, a steam chamber 4 is provided. The flow of water from the water tank 1 to the steam chamber 4 is carried out via an anti-drip device 5 and the drip valve 3.

The anti-drip device 5 is embodied as a one-piece molded part of elastic material and comprises an elongated seal 6 with a molded-on valve tappet 7 and a return spring 8. The free end 9 of the valve tappet 7 extends, for the purpose of guidance, through a fluid flow opening 10 in the bottom 11 of the water tank 1. A sealing cone 12 is provided on the valve tappet 7. A bimetal spring 13 is arranged on the sole-plate 2 and is operatively connected to the seal 6. The bimetal spring 13 is heated by the sole-plate 2. Water from the water tank 1 is supplied to the steam chamber 4 through the fluid flow opening 10 via a water channel 14 formed by the seal 6, and the drip valve 3. The flow of water is regulated, with the help of the anti-drip device 5, in dependence on the sole-plate temperature, in that the bimetal spring 13 heated by the sole-plate 2 moves the valve tappet 7, against the pressure of the return spring 8, more or less in the direction of the water tank 1 and in this way changes the flow cross-section of the fluid flow opening 10. The steam produced in the steam chamber 4 emerges through steam holes 15 in the sole-plate.

Figure 2:
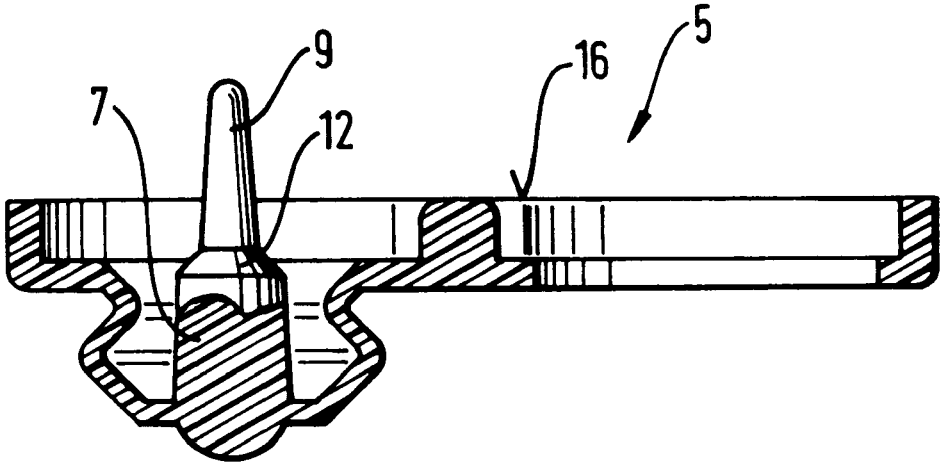
FIG. 2 is a section through the seal of the anti-drip device.
Figure 3:
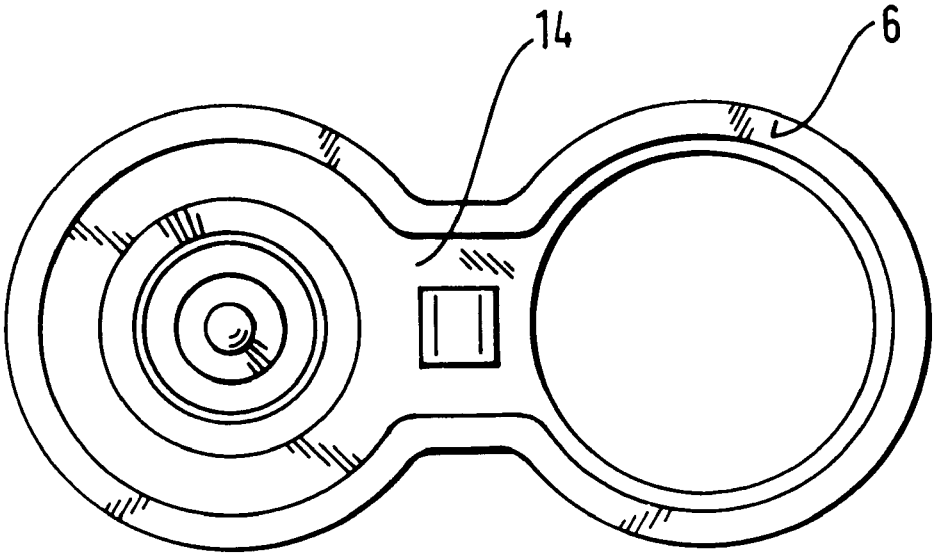
FIG. 3 shows the seal of FIG. 2.

FIGS. 2 and 3 show the seal 6 with the molded-on valve tappet 7. The seal 6, which is made of elastic material, lies with its surface 16 on the bottom 11 of the tank 1. As a result, an additional seal for the water supply channel 14 and the drip valve housing 17 becomes unnecessary.

The invention is not limited by the embodiments described above which are presented as examples only but can be modified in various ways within the scope of protection defined by the appended patent claims.

We claim:

1. A steam iron, comprising:

a water tank;

a sole-plate that defines a steam chamber;

a drip valve that connects the water tank to the steam chamber; and an anti-drip device including a water supply channel between the water tank and the drip valve, a valve tappet with a sealing cone, and a return spring, the anti-drip device being a one-piece molded part of elastic material formed as an elongated seal.

2. A steam iron as defined in claim 1, wherein the water tank has a bottom with a fluid flow opening, the valve tappet having a free end that extends through the fluid flow opening into the water tank.

3. A steam iron as defined in claim 1, wherein the elongated seal is arranged to simultaneously act as a seal between the water tank and a housing of the drip valve.

* * * * *